US006321557B1

(12) United States Patent
Scrivener et al.

(10) Patent No.: US 6,321,557 B1
(45) Date of Patent: Nov. 27, 2001

(54) HOUSING APPARATUS

(76) Inventors: Rhys Scrivener, C/O Channel House, 386 Seafront, Hayling Island, Hampshire P011 0BD (GB); Ronald Brian Parker, Channel House, 386 Seafront, Hayling Island, Hampshire P011 OBD (GB)

( * ) Notice: Subject to any disclaimer, the term of this patent is extended or adjusted under 35 U.S.C. 154(b) by 0 days.

(21) Appl. No.: 09/447,914

(22) Filed: Nov. 23, 1999

(30) Foreign Application Priority Data

Jul. 2, 1999 (GB) ..... 9915740

(51) Int. Cl.[7] ..... F25D 19/00

(52) U.S. Cl. ..... 62/296; 181/202; 181/403; 417/312

(58) Field of Search ..... 62/181, 296; 417/312; 181/198, 200, 202, 403

(56) References Cited

U.S. PATENT DOCUMENTS

| | | | | |
|---|---|---|---|---|
| 1,886,607 | * | 11/1932 | Van Deventer | 62/181 |
| 2,150,700 | * | 3/1939 | Philipp et al. | 62/296 |
| 2,161,027 | * | 6/1939 | Dollinger | 181/200 |
| 3,478,958 | * | 11/1969 | Hinck, III et al. | 417/312 |
| 4,264,282 | * | 4/1981 | Crago | 181/202 |
| 4,903,793 | * | 2/1990 | Firey | 181/198 |
| 5,672,052 | * | 9/1997 | Ishida et al. | 417/312 |
| 5,943,873 | * | 8/1999 | Chung | 62/296 |

FOREIGN PATENT DOCUMENTS

| | | |
|---|---|---|
| 0 612 057 A2 | 8/1994 | (EP) . |
| 2 071 294 A | 9/1981 | (GB) . |

* cited by examiner

*Primary Examiner*—William E. Tapolcai
(74) *Attorney, Agent, or Firm*—Lahive & Cockfield, LLP

(57) ABSTRACT

Noise attenuating apparatus for housing, inter alia, a compressor and/or condenser unit, the apparatus comprises a substantially box-shaped outer shell and an inner shell which houses the unit. The outer shell is formed with a primary air inlet to receive air into the apparatus and a primary air outlet for discharge of spent air from the apparatus. The inner shell includes an inner chamber and is formed with a secondary air inlet to receive air supplied via the primary air inlet means into the inner chamber to supply air to the unit. The inner shell is also formed with a secondary air outlet opening for flow of spent air from the inner chamber. The space between the inner and outer shells defines a tortuous flow path for the removal of spent air from the apparatus through the primary air outlet means.

10 Claims, 3 Drawing Sheets

HOUSING APPARATUS

The present invention provides housing apparatus for machinery and more especially, but not exclusively, to apparatus for housing refrigerator condenser and compressor units.

As is known, in refrigeration systems a compressor circulates a refrigerant from an evaporator through a condenser and expansion valve and back to the evaporator. A refrigerator essentially contains a compressor to move refrigerant (volatile liquid) around a pipe. Refrigerant leaves the expansion valve at low pressure causing it to evaporate inside the pipe within the evaporator and thereby lose heat. The refrigerant leaves the compressor at high pressure. As it flows through the condenser, the high pressure causes the vapour to condense back to liquid, giving out heat as it does so. Thus, heat flows into the air around the condenser.

Combined compressor and condenser units are used to provide a cooling capacity for refrigerators and freezers within commercial premises for example supermarkets. Typically such compressor and condenser units are situated in a location remote from commercial premises as they are generally large and for this reason are space consuming. Moreover, the units are inherently noisy. Noise pollution has become a major social issue as it has been shown to be detrimental to living and working environments and can have an adverse effect on health.

The noise problem associated with compressor and condenser units can be partially solved by housing such units in sound-proofed constructions. Such constructions are commonly built on the "box within a box" principle, whereby the inner box is completely isolated from the outer in order to provide a high degree of sound insulation. For example, sound-proofing apparatus for housing machinery typically comprise a rigid outer shell lined with an insulating layer such as plastic foam and an inner shape inserted into the outer shell to form a space between the outer and inner shell which is also filled with insulating material. One such sound-proofing apparatus is disclosed in European patent application EP 0062166.

In addition to apparatus which eliminates noise through sound insulation and/or sound absorption, there are systems which actively eliminate noise by generating sound waves having the same amplitude but an opposite phase to the waveforms of the noise thereby cancelling the noise produced. One such active noise control system is disclosed in European patent application EP0612057.

In situations where the sound-proofing apparatus is required to house machinery such as compressor and condenser units, overheating within the internal environment of the apparatus is a problem. Overheating in the environment surrounding the machines is generally sensed by a thermostat causing operation of the machinery to cease. Once sufficient cooling has occurred the machines may restart; however, periods in which the machinery is idle can be extremely costful to business. For example, in the United Kingdom refrigerated food displayed in a supermarket must be maintained at a constant temperature not exceeding 4° C. In situations where the temperature of the food has exceeded this limit, the food is considered unfit for sale for human consumption and should be removed and destroyed.

Attempts have been made to overcome this problem of overheating by housing the machinery in very large ventilated units, in order to provide a large internal area for airflow and heat dissipation from the condenser radiator and compressor components. However, such housing units inefficiently utilise space, a feature which is disadvantageous in commercial premises where optimisation of the use of free space is both cost effective and desirable. The desirable aspect associated with reducing the size of housing units is because such units are, in addition to being large, typically heavy and unsightly. Moreover such unnecessarily large units will suffer from difficulties associated with the mobilisation and transport thereof.

It is an object of this invention to provide apparatus for and a method of efficiently controlling both of the aforementioned problems of noise and overheating generally associated with housing machinery such as compressors and condensers, whilst at the same time limiting the size of such apparatus to a workable minimum.

According to the present invention there is provided noise attenuating apparatus for housing, inter alia, a compressor and/or condenser unit, the apparatus comprising a substantially box-shaped outer shell and an inner shell which houses the unit, the outer shell being formed with a primary air inlet means to receive air into the apparatus and a primary air outlet means for discharge of spent air from the apparatus, the inner shell including an inner chamber and being formed with a secondary air inlet means to receive air supplied via the primary air inlet means into the inner chamber to supply air to the unit, the inner shell also being formed with a secondary air outlet opening for flow of spent air from the inner chamber; the space between the inner and outer shells defining a tortuous flow path for the removal of spent air from the apparatus through the primary air outlet means.

The unit of the invention is typically a noise generating piece of apparatus or equipment such as electrical home appliances, computer systems or compressor and condenser units for refrigerators, freezers and air-conditioning equipment. In a preferred aspect of the invention the unit is a combined condenser/compressor.

The apparatus of the invention may house more than one unit, for example two or three units. Preferably, these units will be positioned side by side in the inner shell such that cool air supplied by the inner chamber is drawn into the units and warm air is discharged for removal from the apparatus. In this way a continuous flow of air through the apparatus is maintained.

The housing apparatus is typically a modular construction comprising at least two enclosures separated by an air space. Preferably the housing apparatus will comprise only two enclosures namely an outer and an inner shell.

The outer shell of the housing apparatus is typically formed of three panels secured together to define a box. In order to achieve optimum sound insulation all joints must be secured to provide an airtight seal. The materials of the panels may be metallic for example stainless or galvanised steel. Other materials may of course be used. Preferably, the materials of the outer shell are reflective in order to reflect sunlight and maintain a cool environment in the apparatus. Moreover, it is possible to achieve good sound insulation using multi-layered constructions for example combinations of steel and plasterboard. The panels are typically lined on their inner surfaces with sound absorptive material such as foam or mineral wool, for example Open Cell Foam (Barafire) and Mineral Wool Slab (Rockseal). Preferably, the panel lining is a non-flammable material.

The inner shell of the housing apparatus is typically formed from at least three panels secured together to provide an airtight acoustic seal. Preferably, the inner shell will comprise four panels including two longitudinal side panels, a front panel and a back panel secured to form a box. Preferably, the back panel is removable to allow for servicing of the unit whilst housed in the apparatus. The width of the inner shell will depend upon the dimensions of the unit(s) housed therein. The preferred unit of the invention will ideally be positioned in the inner shell such that the compressor is disposed adjacent to the inner chamber and the condenser is disposed in front of the compressor toward the front panel of the inner shell. In this preferred arrangement the width of the unit will be such that the outer edges of the unit contact inner surfaces of the inner shell thus serving to limit airflow along the sides of the unit and ensure optimum airflow through the unit. The materials of the inner shell may be sound insulating materials as described for the outer shell.

The housing apparatus may be manufactured by inserting the inner shell into the outer shell and filling all or part of the space therebetween with loose acoustic quilting, for example, fibreglass or mineral wool to damp out any cavity resonances. Typically a removable lid will be mounted on the outer shell such that the undersurface of the lid is flush with the uppermost edges of the panels of the outer shell.

The primary air inlet means of the invention is typically a tubular construction which may be formed in a support member for the unit. Moreover, the apparatus may comprise a plurality of tubular constructions all of which provide air to the inner chamber of the inner shell. The air inlet means may be provided at any location in the apparatus. In a preferred aspect of the invention the apparatus comprises two air inlet means supplying air to the upper and lower regions of the inner chamber.

The inner chamber of the invention is supplied with air from the primary air inlet means. The inner chamber is typically a plenum which continuously draws in air from outside via the primary air inlet means.

The invention may further include a fan located in the space between the inner and outer shells, preferably mounted in front of the secondary air outlet opening. A thermostat may be located within the inner shell to actuate the fan when the temperature within the apparatus rises above a predetermined level. Operation of the fan will promote airflow and cooling within the housing apparatus.

The primary air inlet and primary air outlet means of the apparatus comprise openings in the outer shell which are preferably located in different panels of the outer shell, for example in opposite panels.

The tortuous channel is typically U-shaped but may be sinuous or take the form of any other convoluted arrangement. The tortuous channel provides an attenuation route for eliminating low frequency noise. The degree of attenuation will depend upon the length of the channels. Typically, the channel will be at least 1000 mm in length for example between 1500 mm and 3000 mm.

The housing apparatus of the invention provides a method for the control of overheating of units as a result of such units being housed in apparatus to insulate the noise generated therefrom. In order to provide the required free flow of air necessary to prevent overheating in the apparatus of the invention the dimensions of the housing apparatus should be carefully calculated. The dimensions of the housing apparatus will depend upon the dimensions of the unit housed therein. In this respect the following empirical formulae may be employed: Assuming that the velocity of air within the housing apparatus is less than 6 metres per second ($m^{-1}$) and the rate of diffusion through the apparatus, measured as $m^3s^{-1}$, is less than the figure of 0.00144 (or an approximation thereof) multiplied by the width of the unit, the dimensions of the housing apparatus can be calculated as follows:

Length of housing apparatus=length of unit+750 mm, where the length of the unit is less than 900 mm Width of housing apparatus=width of unit+390 mm, where the width of the unit is less than 900 mm Height of housing apparatus=height of unit+390 mm, where the height of the unit is less than 800 mm Where the length of the unit is greater than 900 mm and the width and/or height of the unit are greater than 800 mm, the figures of 750 mm and 390 mm will be greater by the same difference with respect to the dimension to which they refer.

The invention will now be described by way of example only with reference to the accompanying diagrammatic drawings in which.

Figure 1:
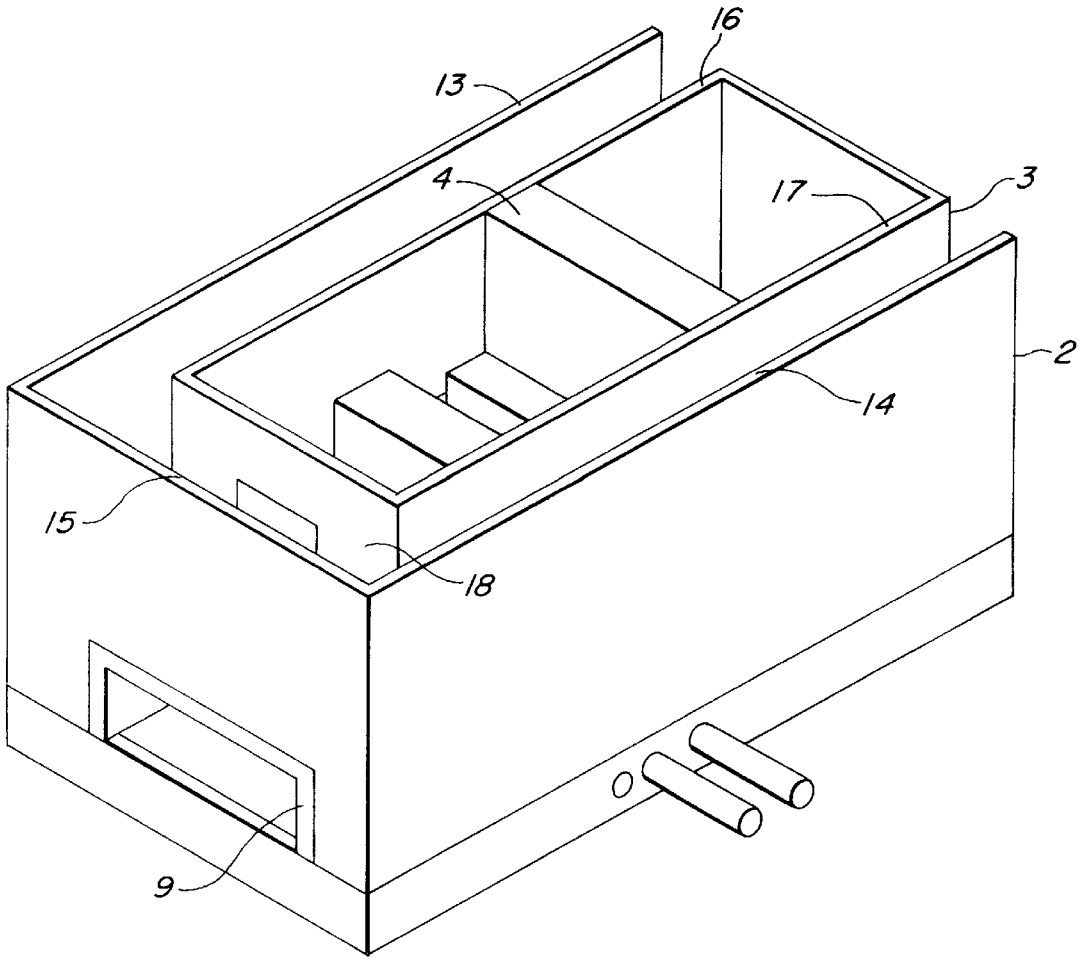
FIG. 1 is a plan view of a housing apparatus according to one embodiment of the invention, showing location of the unit and with the lid removed.
Figure 2:
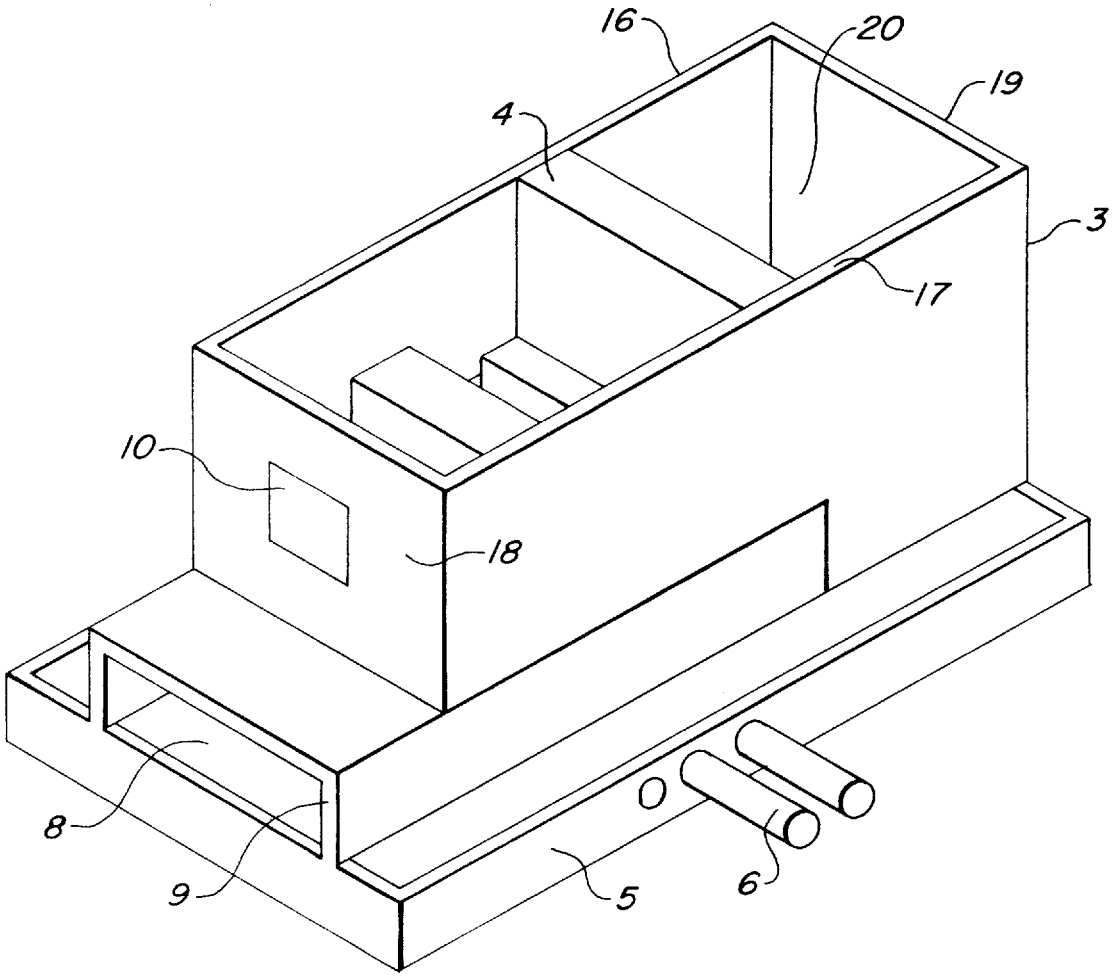
FIG. 2 is a plan view of the housing apparatus shown in FIG. 1 with the lid and outer shell removed.

The housing apparatus illustrated in FIGS. 1 and 2 comprises a box-shaped outer shell 2, a box-shaped inner shell 3 which houses a combined condenser/compressor unit 4, and a base panel element 5 provided with pipes and/or ducts 6 which link the inner chamber of the apparatus to the outside for the passage of wires or cables from the unit.

The outer shell of the apparatus has side panels 13, 14 and a front panel 15 attached to the ends of the side panels. The joint between the panels 13, 14 and the panel 15 of the outer shell are sealed to improve the sound insulating properties of the apparatus.

Figure 3:
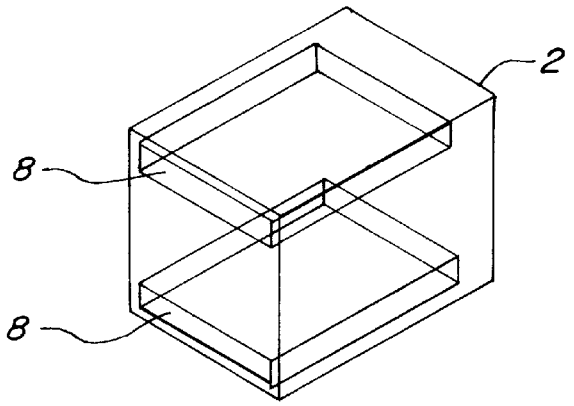
FIG. 3 is a schematic diagram of a housing apparatus illustrating the location of two primary inlet means at the top and bottom of the apparatus according to a further embodiment of the invention.

The unit 4 is supported on a tubular support member 9 in which is provided a tunnel 8 for the passage of air from the ambient into the apparatus. An alternative housing apparatus provided with two air inlet tunnels 8 orientated at the top and bottom of the outer shell respectively, is illustrated in FIG. 3. More than two air inlet tunnels can of course be provided.

The inner shell 3 which encloses an inner chamber 20 has side panels 16, 17, a front panel 18 and a removable back panel 19. As with the outer shell 2 each side panel of the inner shell is sealed to the adjoining panel to provide a good acoustic seal.

The panels of the inner and outer shells are constructed from steel and the internal surfaces thereof are lined with sound absorptive material.

The inner chamber 20 is enclosed by the removable back panel 19 of the inner shell, the side panels 16, 17 and the unit 4 and receives air from the air inlet tunnel 8. The unit 4 abuts the inner surfaces of the side panels 16, 17 to limit airflow along the sides of the unit.

Figure 5:
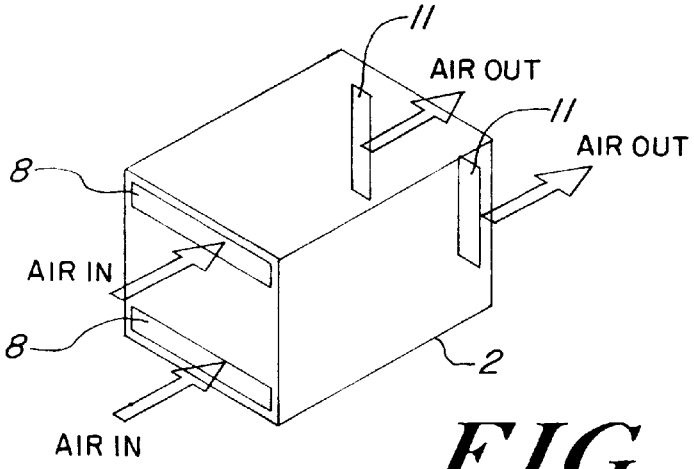
FIG. 5 is a schematic diagram of the housing apparatus shown in FIGS. 1 and 2 illustrating the location of the openings in the inner and outer shells of the apparatus for access of air into the apparatus and discharge of spent air from the apparatus respectively.

Typically, the dimensions of the unit 4 are 900 mm length ×800 mm width ×800 mm height. Therefore, the total volume of the unit is in the order of 0.576 $m^3$. An air outlet opening 10 is provided in the front panel 18 of the inner shell 3. Mounted on the support member 9 is a plate fan (not shown) which in use draws air from inside the inner shell 3, through the opening 10 and out of the unit through outlets 11 (see FIG. 5). The fan is operatively connected to a thermostat (not shown) positioned inside the inner shell 3 which records the temperature of the air therein. When the thermostat senses that the temperature of the air has risen above a predetermined level, the fan will be actuated.

The space between the inner shell 3 and outer shell 2 is fitted with loose acoustic quilting including mineral wool to damp out any cavity resonances.

Figure 4:
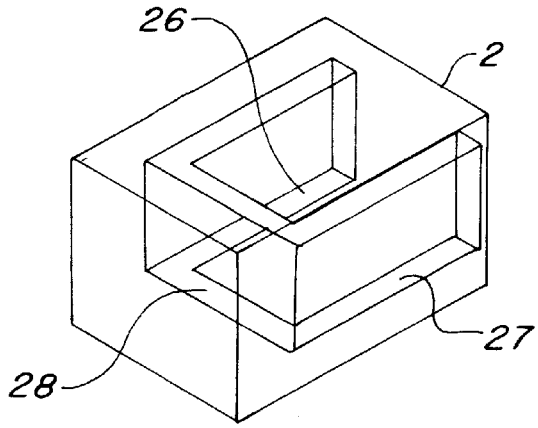
FIG. 4 is a schematic diagram of the housing apparatus shown in FIGS. 1 and 2 illustrating the location of the flowpaths for the removal of spent air from the apparatus.

A channel is defined between the inner shell 3 and outer shell 2 and provides a flow path for the discharge of spent air from the apparatus. As will be seen from FIG. 4 the channel is U-shaped and comprises two longitudinal channels 26, 27 and a connecting channel 28. One of the channels 26 is provided by the space between the panel 13 of the outer shell and the panel 16 of the inner shell. The other channel 27 runs parallel to channel 26 and is provided by the space between the panel 14 of the outer shell and the panel 17 of the inner shell. The connecting channel 28 connects the parallel channels 26 and 27 and is provided by the space between the front panel of the outer shell 15 and the front panel of the inner shell 18.

The outlets 11 formed at the rear of the apparatus between the outer shell and inner shell is covered with netting to provide a barrier to the entry of rodents, debris and the like.

A removable lid (not shown), mounted on the outer shell 2 provides an enclosure wherein the dimensions of the enclosure can be, for example, 1650 mm length ×1190 mm width 1190 mm height, therefore the total volume of the enclosure is in the order of 2.377 $m^3$.

Air from the outside of the apparatus is fed to the inner chamber 20 via the air inlet tunnel 8. Air in the inner chamber is drawn into the unit 4 at a relatively high pressure. In this way the inner chamber 20 serves as a plenum to draw air into the apparatus via the air inlet 8. The flow path for air through the inner shell 3 is generally parallel to the flow of air through the air inlet tunnel 8. Warm air discharged from the unit 4 is drawn through the opening 10 in the inner shell 3 and into the channel 28 provided between the inner and outer shells. At the point of entry into channel 28 the airflow diverges and flows between two L-shaped flow paths. Air flows through the parallel channels 26, 27 provided between the inner and outer shells and out of the apparatus via the outlets 11 provided at the rear of the apparatus.

During operation the airflow through each channel can be, for example, 0.00144 times the width of the channel.

The degree of noise attenuation typically provided by airflow through the channels 26, 27 and 28 is recorded in Table 1.

TABLE 1

| Octave Band Frequency (Hz) | 63 | 125 | 250 | 500 | 1000 | 2000 | 4000 |
|---|---|---|---|---|---|---|---|
| Dynamic Insertion Loss (dB) | 14 | 21 | 40 | 49 | 50 | 50 | 50 |

In another embodiment of the invention, the panels of the outer shell of the housing apparatus are sealed to a box-shaped frame to provide added strength to the apparatus which is desirable where the apparatus is to be lifted and moved.

In a further embodiment of the invention the housing apparatus provides a slideable support member for mounting the unit(s) to allow removal of the unit(s) from the apparatus with ease.

It will readily be apparent that numerous modifications and alterations may be made to the housing apparatus shown in the accompanying drawings without departing from the principles underlying this invention, and all such modifications and alterations are intended to be embraced by this Application.

What is claimed is:

1. Noise attenuating apparatus comprising a housing having a base on which are supported an outer enclosure and an inner enclosure for receiving one of a compressor and a condenser unit, the outer enclosure including a front panel member and side panel members connected to the front panel member through sealed joints, and the inner enclosure including a front panel member, a rear panel member and side panel members connected to the front and rear panel members through sealed joints, a continuous passageway defined between the opposed surfaces of the side and front panels of the inner and outer enclosures, a primary air inlet formed in the front panel of the outer enclosure through which air can enter the housing and whose width is at least equal to the width of the front panel of the inner enclosure, a tubular tunnel member in communication with the air inlet through which air entering the housing can pass to an inner plenum chamber of the inner enclosure which is bordered by the end and side panels of the inner enclosure, the direction of air entering the inner plenum chamber being reversed by contact with the rear panel of the inner enclosure and directed over and through one of the compressor and condenser unit, an air outlet formed in the front panel of the inner enclosure through which air can leave the inner enclosure and enter the passageway defined between the front and side panel members of the inner and outer enclosures, the passageway terminating in air outlets through which spent air can leave the housing.

2. Apparatus as claimed in claim 1 wherein the panels are produced from stainless or galvanized steel.

3. Apparatus as claimed in claim 1 wherein each of the panels have an inner surface lined with sound absorptive material.

4. Apparatus as claimed in claim 1 wherein fiberglass or mineral wood is inserted between the inner and outer enclosures to damp out cavity resonances.

5. Apparatus as claimed in claim 3 wherein a removable lid is mounted on the outer enclosure such that an undersurface of the lid is flush with the uppermost edges of the front and side panels of the outer enclosure.

6. Apparatus as claimed in claim 1 comprising two air inlet means which supply air to the upper and lower regions of the inner chamber.

7. Apparatus as claimed in claim 1 wherein the flow path is at least 1000 mm in length.

8. Apparatus as claimed in claim 7 wherein the flow path length is between about 1500 mm and about 3000 mm.

9. Apparatus as claimed in claim 1 wherein the length of the housing is equal to the length of the unit plus 750 mm, where the length of the unit is less than 900 mm.

10. Apparatus as claimed in claim 9 wherein the height of the housing equals the height of the unit plus 390 mm, where the height of the unit is less than 800 mm.

* * * * *